US008292464B2

(12) United States Patent
Hung et al.

(10) Patent No.: US 8,292,464 B2
(45) Date of Patent: Oct. 23, 2012

(54) LED LAMP

(75) Inventors: Jui-Wen Hung, New Taipei (TW); Ben-Fan Xia, KunShan (CN)

(73) Assignees: Furui Precise Component (Kunshan) Co., Ltd., KunShan, Jiangsu Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/169,037

(22) Filed: Jun. 27, 2011

(65) Prior Publication Data

US 2012/0236567 A1 Sep. 20, 2012

(30) Foreign Application Priority Data

Mar. 14, 2011 (CN) ..... 2011 1 0060583

(51) Int. Cl.
*F21V 29/00* (2006.01)

(52) U.S. Cl. ..... 362/294; 362/373

(58) Field of Classification Search ..... 362/294, 362/373

See application file for complete search history.

(56) References Cited

U.S. PATENT DOCUMENTS

| | | | | |
|---|---|---|---|---|
| 7,097,332 | B2 * | 8/2006 | Vamberi | 362/405 |
| 7,604,380 | B2 * | 10/2009 | Burton et al. | 362/294 |
| 7,914,184 | B2 * | 3/2011 | Liu | 362/373 |
| 8,047,686 | B2 * | 11/2011 | Dahm et al. | 362/294 |
| 2008/0049422 | A1 * | 2/2008 | Trenchard et al. | 362/238 |
| 2010/0246186 | A1 * | 9/2010 | Chang et al. | 362/294 |

* cited by examiner

*Primary Examiner* — Peggy A. Neils

(74) *Attorney, Agent, or Firm* — Altis Law Group, Inc.

(57) ABSTRACT

An LED lamp includes a heat sink, a reflecting cup, a heat pipe and an LED. The heat sink includes fins cooperatively defining a receiving space therein. Each of the fins includes a plate-shaped main body and a flange extending rearward from a periphery side of the main body. The flanges are connected to each other to cooperatively form an annular supporting surface. The reflecting cup is received in the receiving space of the heat sink. The heat pipe includes an evaporating section located above the reflecting cup and a condensing section thermally connecting with the annular supporting surface of the heat sink. The LED is directly mounted on the evaporating section with a light emitting surface facing downwardly towards the reflecting cup.

13 Claims, 7 Drawing Sheets

LED LAMP

BACKGROUND

1. Technical Field

The disclosure relates to illumination devices, and particularly to an LED lamp.

2. Description of the Related Art

Light emitting diodes (LEDs) have many advantages, such as high luminosity, low operational voltage, low power consumption, compatibility with integrated circuits, easy driving, long term reliability, and environmental friendliness. These advantages have promoted wide use of the LEDs as a light source. Now, LEDs are commonly applied in lighting.

However, for a high-power LED lamp, heat accumulation can affect the life, stability and reliability of the lamp. Thus, how to effectively dissipate the heat of the LED lamp has become a challenge for engineers to design the LED lamp.

Therefore, it is desirable to provide an LED lamp which has good heat dissipation capabilities.

DETAILED DESCRIPTION

Embodiments of an LED lamp as disclosed are described in detail here with reference to the drawings.

Figure 1:
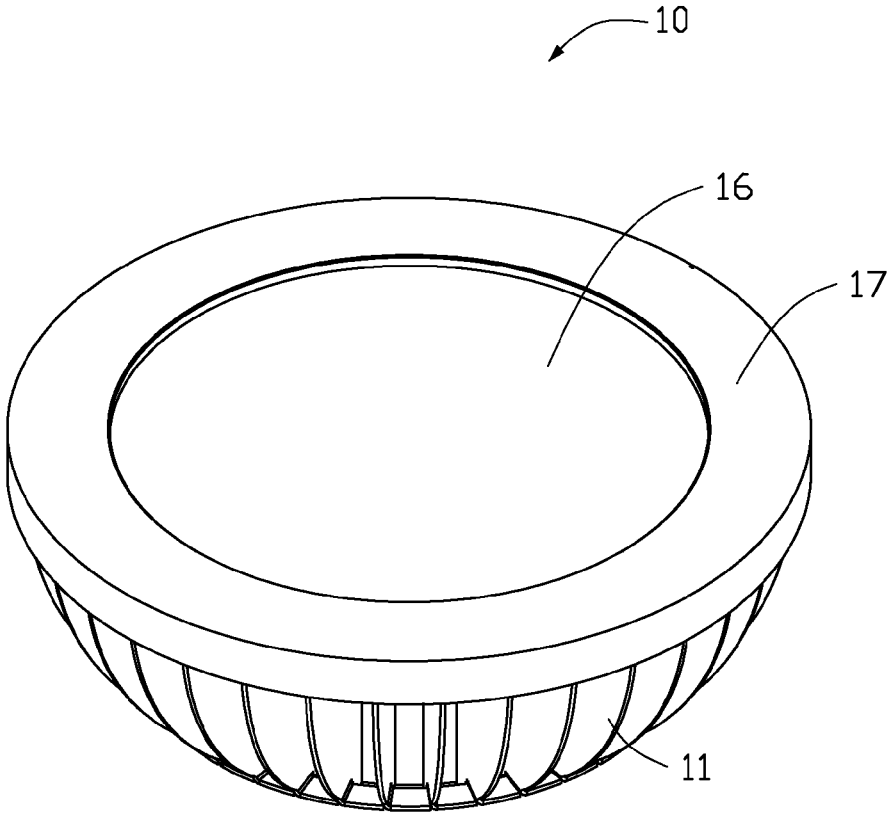
FIG. 1 is a schematic, assembled view of an LED lamp in accordance with a first embodiment, wherein the LED lamp includes a heat sink, a reflecting cup, a heat pipe, an LED, a lens and a lamp cover.
Figure 2:
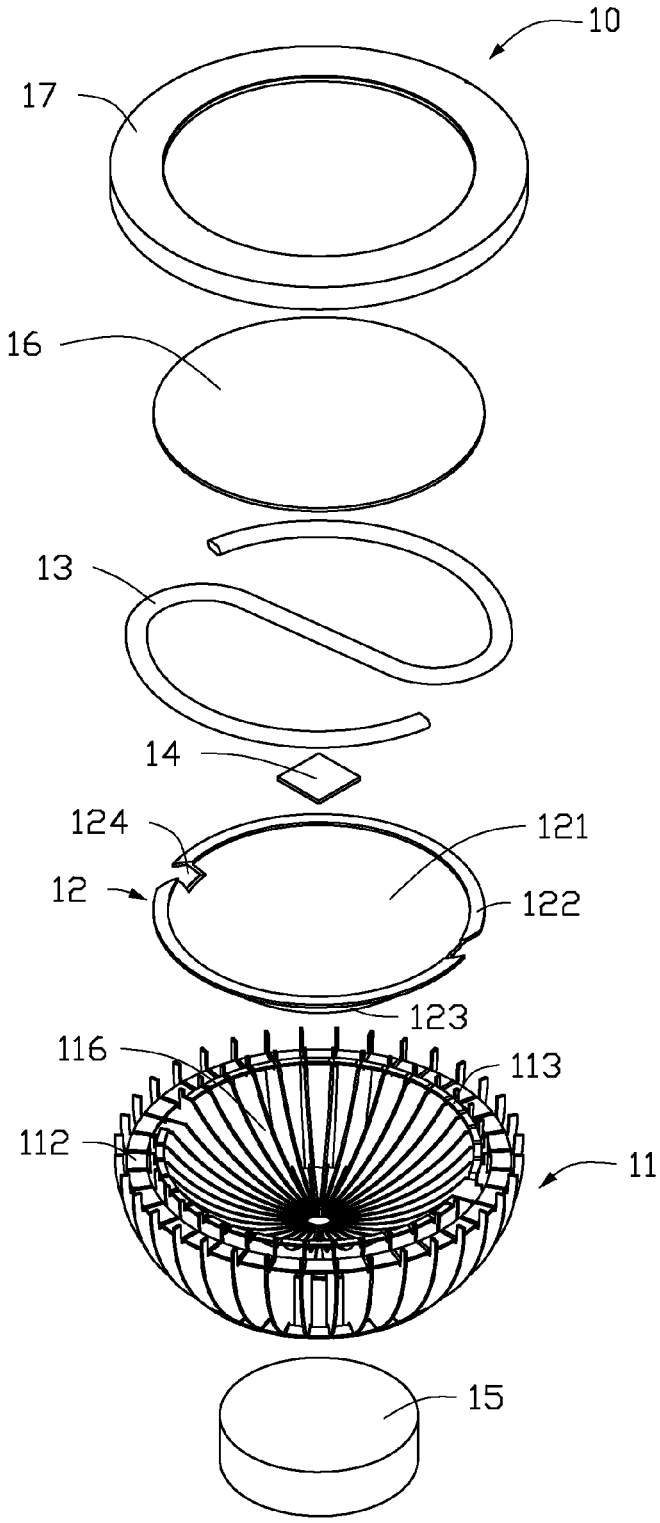
FIG. 2 is an exploded view of the LED lamp of FIG. 1.

Referring to FIGS. 1 and 2, an LED lamp 10 in accordance with a first embodiment includes a heat sink 11, a reflecting cup 12, a heat pipe 13, an LED 14, a drive circuit 15, a lens 16 and a lamp cover 17.

Figure 3:
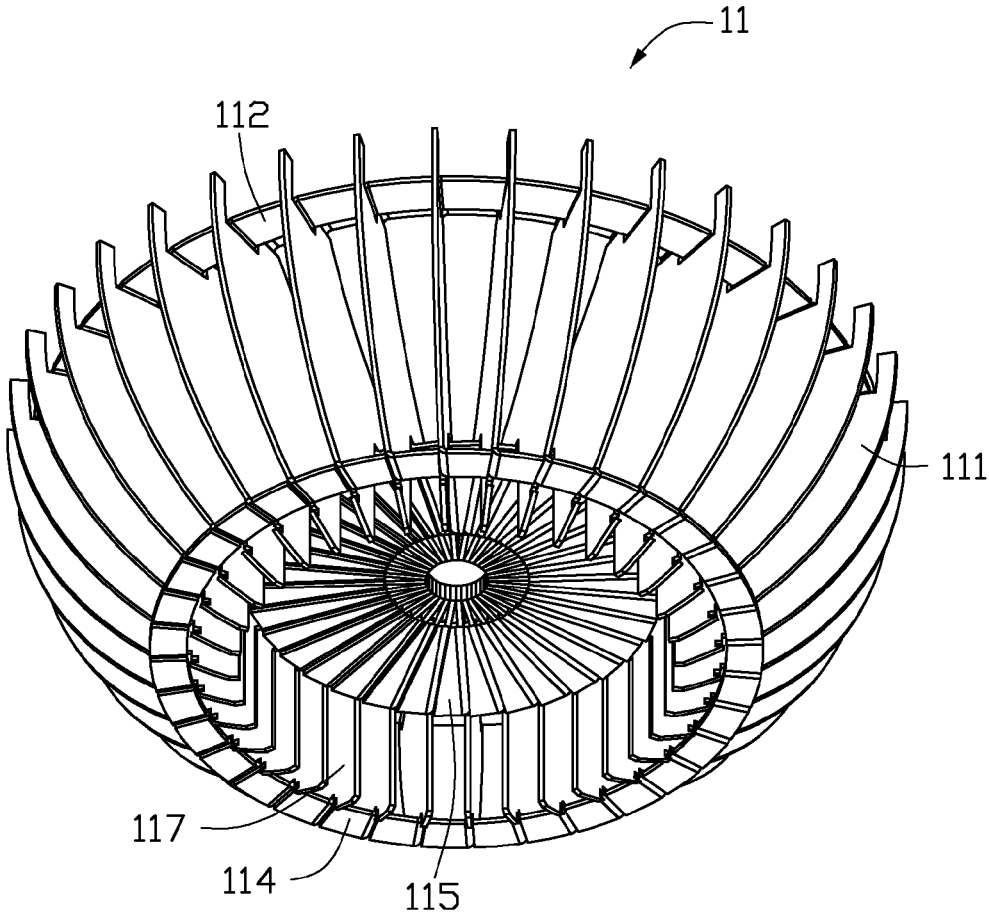
FIG. 3 is an enlarged view of the heat sink of the LED lamp of FIG. 2, wherein the heat sink includes a plurality of fins.
Figure 4:
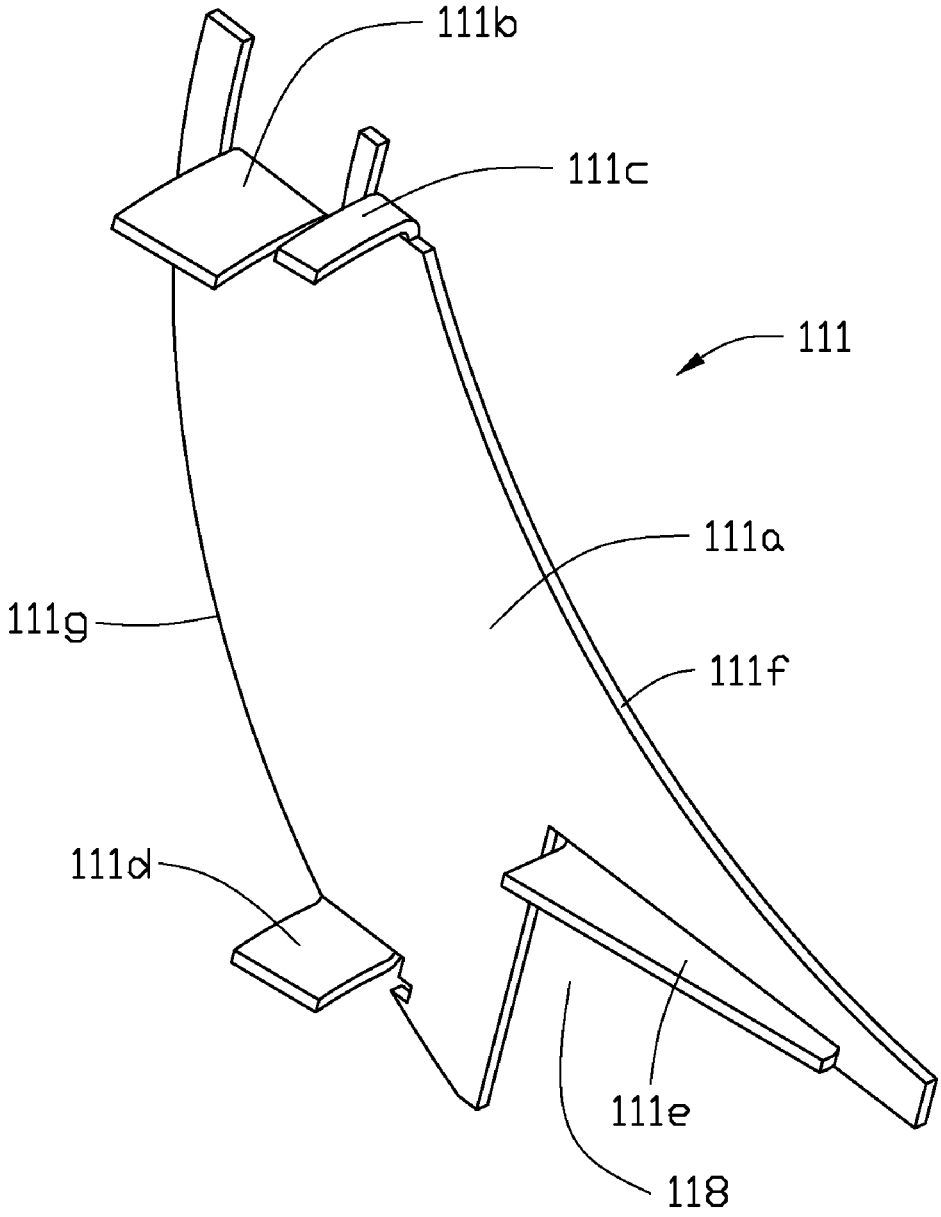
FIG. 4 is an enlarged view of one of the fins of the heat sink of FIG. 3.
Figure 5:
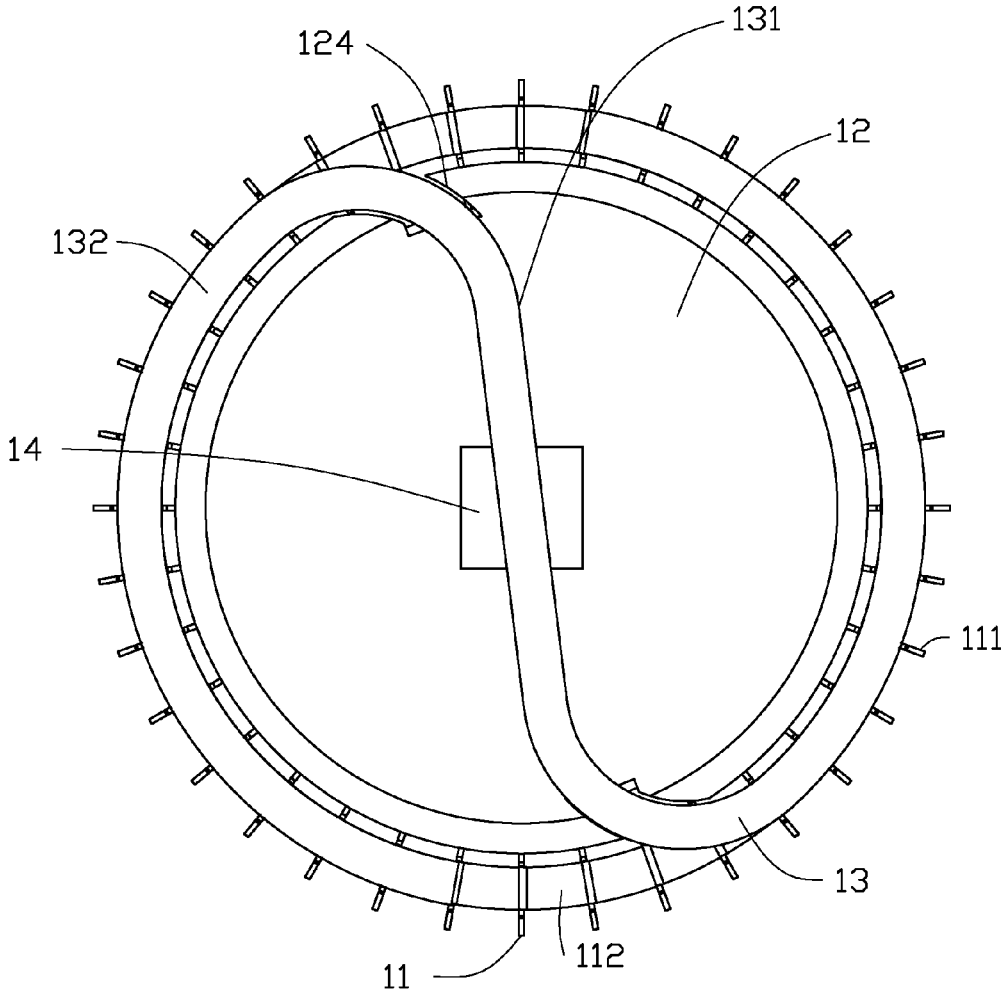
FIG. 5 is a top plan view of the LED lamp of FIG. 1, but with the lens and the lamp cover omitted for purposes of illustration.

Referring also to FIGS. 3 and 4, the heat sink 11 in whole has a shape of a hollow hemisphere. In other words, the heat sink 11 has a shape like a bowl. The heat sink 11 includes a plurality fins 111 stacked together along a circumferential direction of the heat sink 11. Each of the fins 111 includes a plate-shaped main body 111*a*, a first flange 111*b* and a second flange 111*c* extending rearward and perpendicularly from a top side of the main body 111*a*, and a third flange 111*d* and a fourth flange 111*e* extending rearward and perpendicularly from a bottom side of the main body 111*a*. The main body 111*a* is generally falciform-shaped. The main body 111*a* includes an arced inner side 111*f* and an opposite arced outer side 111*g* connected between the top side and the bottom side. A triangular cutout 118 is defined in a bottom end of the main body 111*a*. The cutout 118 is located between the third flange 111*d* and the fourth flange 111*e*. The fourth flange 111*e* extends along an edge of the cutout 118 which is located near the inner side 111*f*.

When the heat sink 11 is assembled, the fins 111 are connected to each other along a circumference direction of the heat sink 11. The first flanges 111*b* of each two neighboring fins 111 contact each other to cooperatively define an annular first supporting surface 112 of the heat sink 11, the second flanges 111*c* of each two neighboring fins 111 contact each other to cooperatively define an annular second supporting surface 113 of the heat sink 11, the third flanges 111*d* of each two neighboring fins 111 contact each other to cooperatively define an annular connecting surface 114 of the heat sink 11, and the fourth flanges 111*e* of each two neighboring fins 111 contact each other to cooperatively define an annular step surface 115 of the heat sink 11. The connecting surface 114 is configured for mounting the LED lamp 10 at a required position when the LED lamp 10 is used. The main bodies 111*a* of the fins 111 are equally spaced from each other along the circumference direction of the heat sink 11. The inner sides 111*f* of the fins 111 are located at an imaginary spherical surface, to thereby cooperatively define a conical receiving space 116 in a central portion of the heat sink 11. The cutouts 118 of the fins 111 communicated with each other to cooperatively define an annular receiving groove 117 at the bottom end of the heat sink 11. The receiving groove 117 is separated from the receiving room 116 by the step surface 115.

The reflecting cup 12 is generally bowl-shaped, and includes an annular hem 122 extending outward from a top end thereof. The reflecting cup 12 has a smooth conical reflecting inner surface 121 and an opposite outer surface 123. The reflecting cup 12 is made of highly reflecting material, such as metal or glass. The reflecting cup 12 is received in the receiving space 116 of the heat sink 11, with the outer surface 123 tightly contacted the inner sides 111*f* of the fins 111. When the reflecting cup 12 is received in the receiving space 116 of the heat sink 11, the annular hem 122 is affixed to the second supporting surface 113 of the heat sink 11, to connect the reflecting cup 12 and the heat sink 11 together. Two gaps 124 are defined in two opposite sides of the annular hem 122, for allowing the heat pipe 13 extending therethrough.

The heat pipe 13 is flat, and includes a substantially straight evaporating section 131 and two arced condensing sections 132 extending outward from two opposite ends of the evaporating section 131, respectively. In this embodiment, the heat pipe 13 is generally S-shaped. The condensing sections 132 are located at an imaginary circle which has a diameter substantially equal to that of a circle formed by the first supporting surface 112 of the heat sink 11. The evaporating section 131 and the condensing sections 132 are coplanar. When assembled, the heat pipe 13 is located above the reflecting cup 12 with a center of the evaporating section 131 aligned with a center of the annular hem 122 of the reflecting cup 12. The condensing sections 132 of the heat pipe 13 contact the first supporting surface 112 of the heat sink 11 and thermally and mechanically connect the first supporting surface 112 of the heat sink 11 by soldering.

The LED 14 is arranged at the center of the evaporating section 131 of the heat pipe 13, with a light emitting surface facing downwardly towards the reflecting inner surface 121 of the reflecting cup 12. The LED 14 connects the evaporating section 131 by soldering.

The lens 16 is circular, and covered on the reflecting cup 12. The lens 16 is made of transparent material, such as epoxy resin, polymethyl methacrylate (PMMA), and so on. The lens 16 is configured to modulate the characteristics of light generated by the LED 14 to satisfy different requirements.

The lamp cover 17 is covered on the heat sink 11 and the reflecting cup 12. The lamp cover 17 and the lens 16 cooperate to protect the LED 14 from dust and dirt.

The driving circuit 15 is located under the reflecting cup 12 and received in the receiving groove 117 of the heat sink 11. The driving circuit 15 is electrically connected between the LED 14 and an outer power source (not shown), to thus supply an electric power to the LED 14.

When used, light emitted by the LED 14 is first incident on the reflecting inner surface 121 of the reflecting cup 12, then is reflected by the reflecting inner surface 121 to the lens 16 and the lamp cover 17, and finally emits out of the LED lamp 10 by travelling through the lens 16 and the lamp cover 17. Since all of the light emitted from the LED 14 are reflected by the reflecting inner surface 121 of the reflecting cup 12 one or more times before emitting out of the LED lamp 10, dazzling light is avoided. Due to the LED 14 directly contacts the evaporating section 131 of the heat pipe 13, heat generated by the LED 14 can be quickly absorbed by the evaporating section 131 and then evenly transferred to the fins 111 of the heat sink 11 along an extension the condensing sections 132. Thus, the heat generated by the LED 14 can be dissipated to a surrounding environment via the heat sink 11 effectively.

Figure 6:
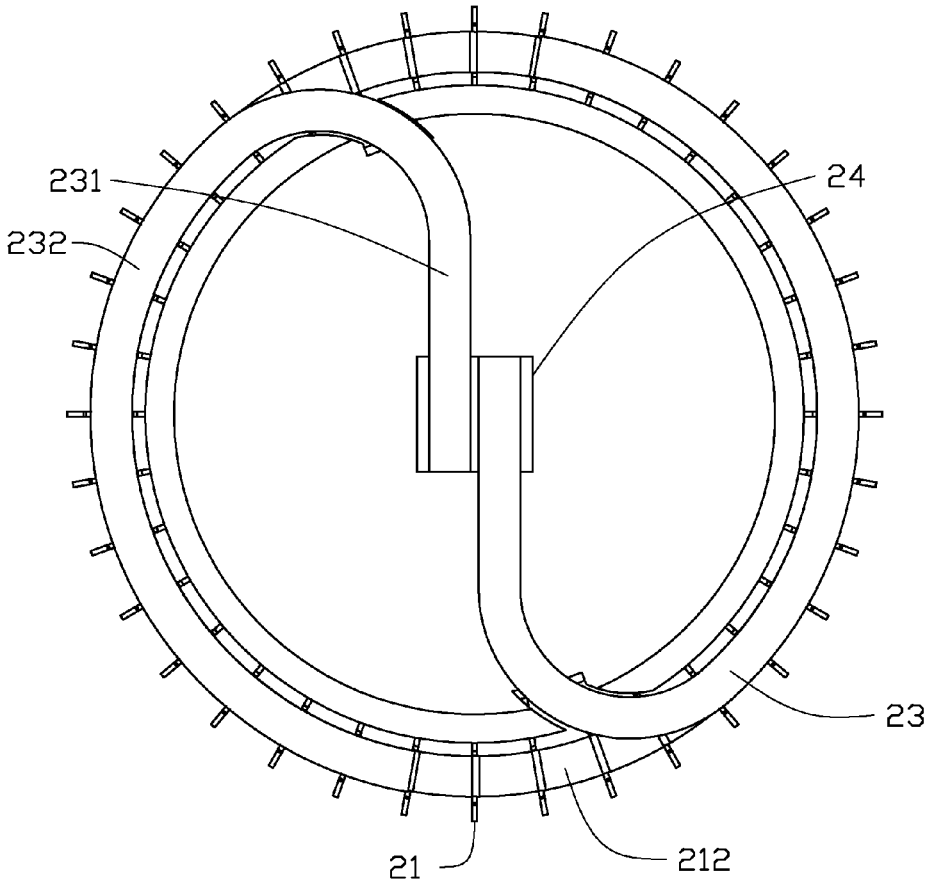
FIG. 6 is a top plan view similar to FIG. 5, showing an LED lamp in accordance with a second embodiment.

Referring to FIG. 6, an LED lamp in accordance with a second embodiment of the disclosure is illustrated. The LED lamp differs from the previous embodiment only in that the LED lamp includes two heat pipes 23, each of which is about G-shaped. Each of the heat pipes 23 includes a C-shaped condensing section 232 and a substantially straight evaporating section 231 extending outward from one end of the condensing section 232. The heat pipes 23 are coplanar to each other, with the condensing sections 232 of the two heat pipes 23 being located at the imaginary circle which has the diameter substantially equal to that of the circle formed by the first supporting surface 112 of the heat sink 11. Each of the evaporating sections 231 has a length substantially equal to a radius of the circle formed by the first supporting surface 112 of the heat sink 11, and extends from a corresponding condensing section 232 to a position adjacent the center of the annular hem 122 of the reflecting cup 12. The LED 24 is soldered to the distal ends of the evaporating sections 231, with a light emitting surface facing downwardly towards the reflecting cup 12. The condensing sections 232 of the heat pipes 23 thermally and mechanically connect the first supporting surface 112 of the heat sink 11 by soldering.

Figure 7:
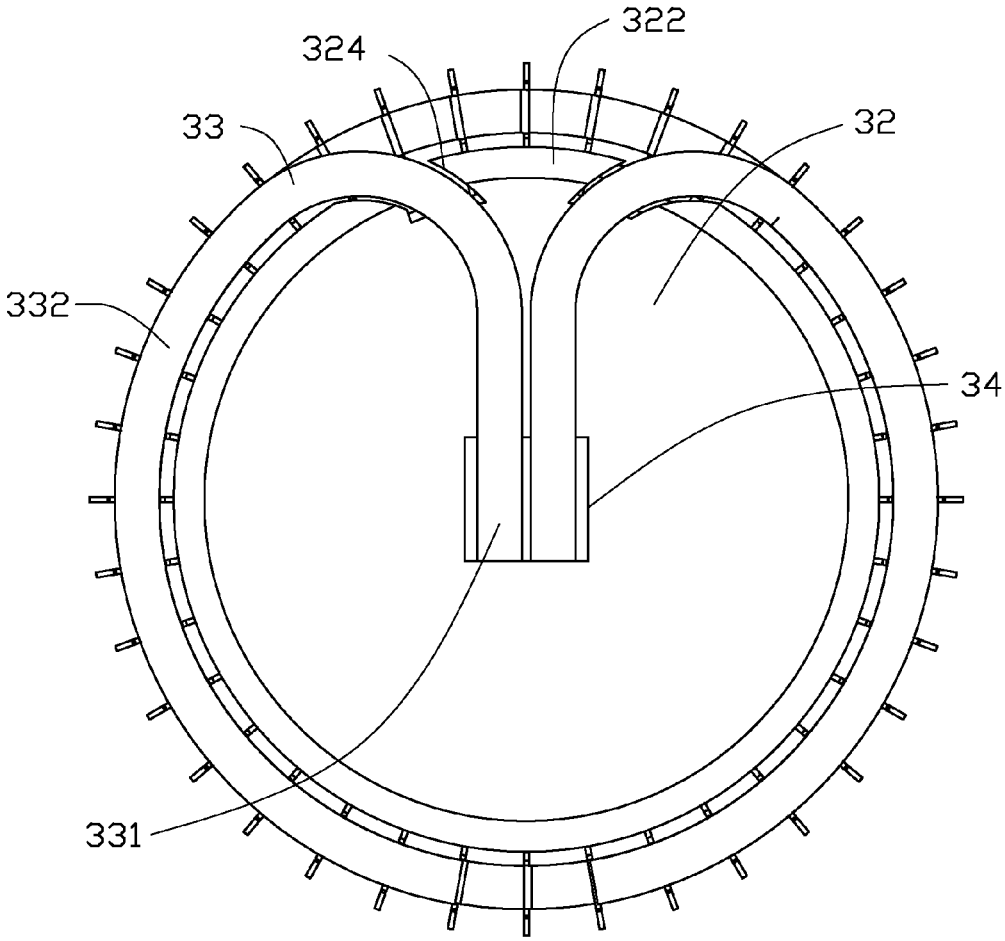
FIG. 7 is a top plan view similar to FIG. 5, showing an LED lamp in accordance with a third embodiment.

Referring to FIG. 7, an LED lamp in accordance with a third embodiment of the disclosure is illustrated. The LED lamp differs from the previous embodiment only in that the LED lamp includes a heat pipe 33 which has a shape more or less like a heart, and the gaps 324 defined in the annular hem 322 of the reflecting cup 32 are arced and adjacent to each other, in which outer ends (not labeled) of the gaps 324 are divergent from each other and inner ends (not labeled) of the gaps 324 are convergent toward each other. The heat pipe 33 includes an arced condensing section 332 and two straight evaporating sections 331 extending inwardly from two opposite ends of the condensing section 332, respectively. A circle on which the condensing section 332 is located has a diameter substantially equal to that of the circle formed by the first supporting surface 112 of the heat sink 11. Each of the evaporating sections 331 extends from a corresponding end of the condensing section 332 to a position adjacent to the center of the condensing section 332. The LED 34 is soldered to the distal ends of the evaporating sections 331 of the heat pipe 33. Thus, heat generated by the LED 34 can be absorbed by the two evaporating sections 331 of the heat pipe 33 simultaneously and then transferred to the heat sink 11 via the condensing section 332, to further enhance a heat dissipation efficiency thereof.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. An LED lamp, comprising:

a heat sink comprising a plurality of the fins cooperatively defining a receiving space therein, each of the fins comprising a plate-shaped main body and a flange extending from a periphery side of the main body, the flanges of the fins connected to each other to cooperatively form an annular supporting surface;

a reflecting cup received in the receiving space of the heat sink;

a heat pipe comprising an evaporating section located above the reflecting cup and a condensing section attached to and thermally connecting with the annular supporting surface of the heat sink; and an LED directly mounted on the evaporating section with a light emitting surface thereof facing downwardly towards the reflecting cup.

2. The LED lamp of claim 1, wherein the heat pipe further comprises another condensing section, the condensing section and the another condensing section extending outward from two opposite ends of the evaporating section, respectively, and located at an imaginary circle which has a diameter substantially equal to that of a circled formed by the supporting surface.

3. The LED lamp of claim 2, wherein the heat pipe is substantially S-shaped.

4. The LED lamp of claim 2, wherein the reflecting cup comprises a conical inner reflecting surface facing the LED, the LED mounted at a position of the evaporating section, which is aligned with a center of the reflecting cup.

5. The LED lamp of claim 1, further comprising another heat pipe comprising another evaporating section and another condensing section, the condensing section and the another condensing section being located at an imaginary circle which has a diameter substantially equal to that of a circle formed by the supporting surface.

6. The LED lamp of claim 5, wherein each of the heat pipes is substantially G-shaped.

7. The LED lamp of claim 5, wherein the reflecting cup comprises a conical inner reflecting surface facing the LED, each of the evaporating sections extending from a corresponding condensing section to a position adjacent to a center of the reflecting cup, the LED mounted at distal ends of the evaporating sections.

8. The LED lamp of claim 1, wherein the condensing section is substantially C-shaped and has a diameter substantially equal to that of a circle formed by the supporting surface, the heat pipe comprising another evaporating section, the evaporating sections extending from two opposite ends of the condensing section, respectively.

9. The LED lamp of claim 8, wherein the reflecting cup comprises a conical inner reflecting surface facing the LED, each of the evaporating sections extending from a corresponding end of the condensing section to a position adjacent to a center of the reflecting cup, the LED mounted at distal ends of the evaporating sections.

10. The LED lamp of claim 1, further comprising a lens located above the heat pipe and covered on the reflecting cup.

11. The LED lamp of claim 10, further comprising a lamp cover covered on the heat sink and the lens for protecting the LED from dust and dirt.

12. The LED lamp of claim 1, wherein each of the fins defines a cutout at a bottom end thereof, the cutouts communicated with each other to cooperatively defining a receiving groove for receiving a drive circuit therein.

13. The LED lamp of claim 1, wherein each of the fins further comprises another flange extending from a top side of the main body, the another flanges of the fins connect to each other to cooperatively form another annular supporting surface, the reflecting cup comprising an annular hem extending outward from a top end thereof, the annular hem connected with the another annular supporting surface.

* * * * *